US011172729B2

(12) United States Patent
Kim

(10) Patent No.: US 11,172,729 B2
(45) Date of Patent: Nov. 16, 2021

(54) NON-SLIP SHOE WEAR

(71) Applicants: Wefoot Technology Inc., Bucheon-si (KR); Son Ki Min, College Point, NY (US)

(72) Inventor: Tae Hyo Kim, Seoul (KR)

(73) Assignees: Wefoot Technology Inc., Bucheon-si (KR); Son Ki Min, College Point, NY (US)

( * ) Notice: Subject to any disclaimer, the term of this patent is extended or adjusted under 35 U.S.C. 154(b) by 30 days.

(21) Appl. No.: 16/577,216

(22) Filed: Sep. 20, 2019

(65) Prior Publication Data

US 2021/0085027 A1 Mar. 25, 2021

(51) Int. Cl.

| | |
|---|---|
| ***A43B 13/02*** | (2006.01) |
| ***A43B 13/04*** | (2006.01) |
| ***A43B 17/10*** | (2006.01) |
| ***A43B 13/22*** | (2006.01) |

(52) U.S. Cl.

CPC ..... *A43B 13/22* (2013.01); *A43B 13/02* (2013.01); *A43B 13/04* (2013.01); *A43B 13/226* (2013.01); *A43B 17/102* (2013.01)

(58) Field of Classification Search

CPC ..... A43B 17/102; A43B 17/14; A43B 17/10; A43B 1/0009; A43B 5/08; A43B 13/26; A43B 13/226; A43B 13/223; A43B 13/22

See application file for complete search history.

(56) References Cited

U.S. PATENT DOCUMENTS

| | | | | |
|---|---|---|---|---|
| 3,676,940 | A * | 7/1972 | Shively | A43B 5/08 36/8.1 |
| 6,389,711 | B1 * | 5/2002 | Polegato | A43B 7/08 36/3 R |
| 7,219,446 | B1 * | 5/2007 | Haimerl | A43B 7/125 12/142 T |
| 9,498,003 | B2 | 11/2016 | Cherneski | |
| 2019/0313732 | A1 * | 10/2019 | Russell | A43B 23/0215 |
| 2019/0350272 | A1 * | 11/2019 | Ko | A41B 11/008 |

FOREIGN PATENT DOCUMENTS

| | | | |
|---|---|---|---|
| CN | 103568387 | A * | 2/2014 |
| KR | 10-1638404 | B1 | 7/2016 |
| KR | 10-1686547 | B1 | 12/2016 |
| KR | 101686547 | B1 * | 12/2016 |
| WO | WO-2019182176 | A1 * | 9/2019 |

OTHER PUBLICATIONS

Non slip socks for sports ( KR 101686547 B1 ) Dec. 14, 2016—Translation (Year: 2016).*

WIPO IP Portal, English Language Machine Translation of WO2019182176 (Kim Tae Hyo)—Non Slip Footwear (Original Publication Date Sep. 2019); translation accessed Jan. 8, 2021.*

* cited by examiner

*Primary Examiner* — Clinton T Ostrup
*Assistant Examiner* — Keith D Stephan-Giermek
(74) *Attorney, Agent, or Firm* — Rabin & Berdo, P.C.

(57) ABSTRACT

A non-slip shoe wear has a non-slip part on each of an inner surface and an outer surface. The non-slip shoe wear can prevent an injury to the skin while maintaining a non-slip function by alternately arranging a non-slip part of an inner surface and a non-slip part of an outer surface.

3 Claims, 8 Drawing Sheets

NON-SLIP SHOE WEAR

BACKGROUND OF THE INVENTION

Field of the Invention

The present invention relates to a non-slip shoe wear having a non-slip part on each of an inner surface and an outer surface, particularly, a non-slip shoe wear that can prevent an injury to the skin while maintaining a non-slip function by alternately arranging a non-slip part of an inner surface and a non-slip part of an outer surface.

Description of the Related Art

A foot is a part of a human body that balances the body and supports a weight to absorb an impact. This is where many blood vessels and nerves pass.

As a means to protect the foot, stockings, tights, oversocks, socks etc. (hereinafter referred to as "shoe wear" as a whole) are used.

In addition to the basic protection function, the shoe wear can also be equipped with additional features such as improved athletic performance, injury prevention, and reduced foot odor through a sweat absorption.

In typical shoe wear, a slip between soles and inner surfaces of the shoe wear is generated or a slip between outer surface of the shoe wear and the inner surfaces of the shoes is generated, due to the low coefficient of friction of the selected fiber materials during use thereof.

For example, in a case of the shoe wear such as the stockings or the oversocks etc., when a woman wears a high-heeled heel (shoe) in a state of wearing the shoe wear, the weight of the feet is concentrated forward, and the feet are drawn toward the front of the shoes to concentrate the force on the toes, thereby causing pain and spasticity on the top of the foot, the ankle, and even plantaris muscle, thereby causing fatigue and pain of the feet.

Also, when the user steps on a foot, the slip occurs between the foot and the stocking and the slip occurs between the stocking and the shoe, owing to the force and weight every time the user step, so that the impact is applied to the toe, and the shock is continuously generated while walking.

In addition, when the heel is slipped, as the heels are worn, the heel of the user is pulled out and the ankle is easily bent or the gait is unstable, causing an ankle to sprain easily.

According to the report of the Health Insurance Review and Assessment Service, there were 1.6 million patients with ankle sprains in 2010, but it has increased to 1.86 million patients in 2014.

On the other hand, in a case of sports activities such as running and skating, etc. when the wearer changes speed or changes direction or when the wearer starts or stops suddenly during a sports activity, a phenomenon of slipping in the sock occurs and the socks can be slipped within the shoes.

This is due to the lack of sufficient grip ability between the feet and the socks or the socks and the shoes.

This lack of sufficient grip ability causes the athlete to injure their ankles or their knees etc. due to the slipping.

In an effort to prevent the injuries caused by the slip phenomenon as described above and to improve athletic performance, "non-slip socks for sports" (Korean Patent Registration No. 10-1686547, Patent Literature 1) and "non-slip insole for sports" (Korea Patent registration No. 10-1638404, Patent Literature 2) and the like are disclosed.

Patent Literatures 1 and 2 relate to a cross-sectional structure of a material for enhancing non-slip function in socks and insoles, and a manufacturing method thereof.

As another technique on such a gripping material, "Construction of a gripping fabric" (U.S. Pat. No. 9,498,003, Patent Literature 3), in which the non-slip materials are formed on the inner surface and the outer surface of the shoe wear body respectively and it allows the non-slip material on the inner surface and the non-slip material on the outer surface to coincide or overlap each other on a plane so as to maximize the athletic ability, is disclosed.

Patent Literature 3 relates to a technique for disposing a material for enhancing the non-slip function. By means of the overlapping or the integration of the non-slip materials, it can maximize the friction force of the contacting portion between the shoe wear body and the feet or the shoe wear body and the shoes, based on each point where the slips occur.

When analyzing the reviews of users who actually purchase and use the products disclosed in Patent Literature 3, there is no difference about the increased prevention of slip. However, due to the excessive non-slip function, there is a problem in that the wearer's foot is injured by wearing away the skin to form a wound.

This phenomenon occurs when the wearer's foot and the non-slip material of the shoe wear body adheres well during sports activities (during closely contacting between the inner non-slip material of the shoe wear body and the sole of the foot, and the outer non-slip material of the shoe wear body and the inside of the shoe at the same point thereof). That is, when the weight of the wearer is loaded at the corresponding point, since the weight is transferred to the same point, the skin receives very large force at that point.

At this time, the better the non-slip performance of the non-slip material, the more overwhelming the skin is subjected to the force.

In particular, since the skin located on the side adjacent to the sole of the foot of the wearer is composed of a weaker skin than the sole of the foot, the injury can be more easily generated on the corresponding skin.

In addition, when the non-slip material is formed to protrude in the same point of the inside and the outside of the shoe wear body by means of a coating manner, it gives a foreign body sensation to the foot when worn. Also, when worn for a long time, the foreign body sensation is changed into an oppressive sensation by applying continuous pressure. At this time, the thinner the shoe wear body, the greater the foreign body sensation and the oppressive sensation. Hence, the wearer's skin coming in contact with the non-slip material tingles and has redness and/or irritation due to friction. In severe cases, blisters and wounds may occur.

As described above, as the gripping ability of the anti-slip material is essential to maximize the exercise ability and prevent the injury caused by the slip phenomenon, there is a need to newly present an arrangement of the anti-slip material corresponding thereto.

PATENT LITERATURE

Patent Literature 1: KR 10-1686547 B (Dec. 8, 2016)
Patent Literature 2: KR 10-1638404 B (Jul. 5, 2016)
Patent Literature 3: U.S. Pat. No. 9,498,003 B (Nov. 22, 2016)

SUMMARY OF THE INVENTION

In order to solve the problems in the related art described above, the non-slip shoe wear of the present invention has been designed to prevent an injury to the skin by preventing an excessive non-slip function over an appropriate non-slip function because a material preventing a slip is alternately disposed on the inner surface and the outer surface of a shoe wear body.

In more detail, an anti-slip substance is configured as a wet-type polyurethane sheet having a tumbler-shaped column cells and non-slip grooves to improve a non-slip function. Further, the anti-slip substances are alternately arranged on the inner and outer surfaces of the shoe wear body to be able to an excessive non-slip function.

In particular, the wet-type polyurethane sheet is bonded and fixed to the shoe wear body in a hot-melt type and the inner side that comes in direct contact with a foot of a user is formed such that the hot-melt bonded layer is smaller in size than the wet-type polyurethane sheet, so the gap between the inner non-slip section and the outer non-slip section is minimized, thereby preventing deterioration of a non-slip function due to alternate arrangement. Further, the inner non-slip section has an outer non-bonded layer not bonded by the hot-melt bonded layer to minimize an injury to the wearer's body even if the inner non-slip section and the outer non-slip section overlap due to flexible deformation of the shoe wear body.

Further, an upper drain space spaced apart from the shoe wear body is naturally formed under the outer non-bonded layer, so a space in which remaining sweat not absorbed into the shoe wear body is discharged and remains is formed by the upper drain space to prevent deterioration of the non-slip function due to a large amount of sweat and provide pleasant fit.

According to an aspect of the invention to achieve the object described above, there is provided a non-slip shoe wear having an inner surface part (1*a*), which comes in contact with the foot of a wearer, on a sole of a shoe wear body (1) in which the wearer's foot is accommodated, and an outer surface part (1*b*) beneath the sole, wherein the inner surface part (1*a*) is composed of inner non-slip sections (10) made of a material preventing a slip, and inner slip sections (20) that are sections where the inner non-slip sections (10) are not formed; the outer surface part (1*b*) is composed of outer non-slip sections (30) made of a material preventing a slip, and outer slip sections (40) that are sections where the outer non-slip sections (30) are not formed; and the inner non-slip sections (10) and the outer non-slip sections (30) are alternately arranged not to vertically overlap in a side cross-section.

Preferably, a plurality of column cells (71) having a tumbler shape having an inner diameter of a distal end larger than an inner diameter of a close end portion from a portion fixed to the shoe wear body (1) are formed on each of the outer non-slip section (30) and the inner non-slip section (10), and the outer non-slip section (30) and the inner non-slip section (10) are each made of a wet-type polyurethane sheet (70) having non-slip grooves (72) that entirely or partially communicate with column cells (71) are formed on the surface of the distal end side from the portion fixed to the shoe wear body (1).

Preferably, the wet-type polyurethane sheet (70) is bonded to the shoe wear body (1) through a hot-melt bonded layer (73); an end of the hot-melt bonded layer (73) is positioned inward further than the end of a wet-type polyurethane sheet (70) constituting the inner non-slip section (10); and the wet-type polyurethane sheet (70) is composed of a center bonded layer (11) bonded to the hot-melt bonded layer (73) and an outer non-bonded layer (12) of which the edge is not bonded to the hot-melt bonded layer (73), thereby forming an upper drain space (90) spaced apart from the shoe wear body (1).

Preferably, the inner non-slip section (10) and the outer non-slip section (30) are alternately arranged to form blank portions (50) such that vertically adjacent ends are spaced apart from each other in a side cross-section.

Preferably, the wet-type polyurethane sheet (70) is bonded to the shoe wear body (1) through the hot-melt bonded layer (73); the wet-type polyurethane sheets (70) constituting the inner non-slip section (10) have a square shape and are spaced apart from each other transversely and longitudinally in the shoe wear body (1); the hot-melt bonded layer (73) bonding the wet-type polyurethane sheets (70) constituting the inner non-slip section (10) and the shoe wear body (1) has a circular shape inscribed to the square polyurethane sheets (70); the wet-type polyurethane sheets (70) constituting the inner non-slip section (10) is composed of the center bonded layer (11) bonded to the hot-melt bonded layer (73) and the outer non-bonded layer (12) forming the upper drain space (90) spaced apart from the shoe wear body (1) without the bottom bonded to the hot-melt bonded layer (73); and the outer non-slip section (30) is disposed between adjacent inner non-slip sections (10) in a plane.

BRIEF DESCRIPTION OF THE DRAWINGS

The above and other objects, features and advantages of the present invention will be more apparent from the following detailed description taken in conjunction with the accompanying drawings, in which.

REFERENCE SIGNS LIST

Figure 1:
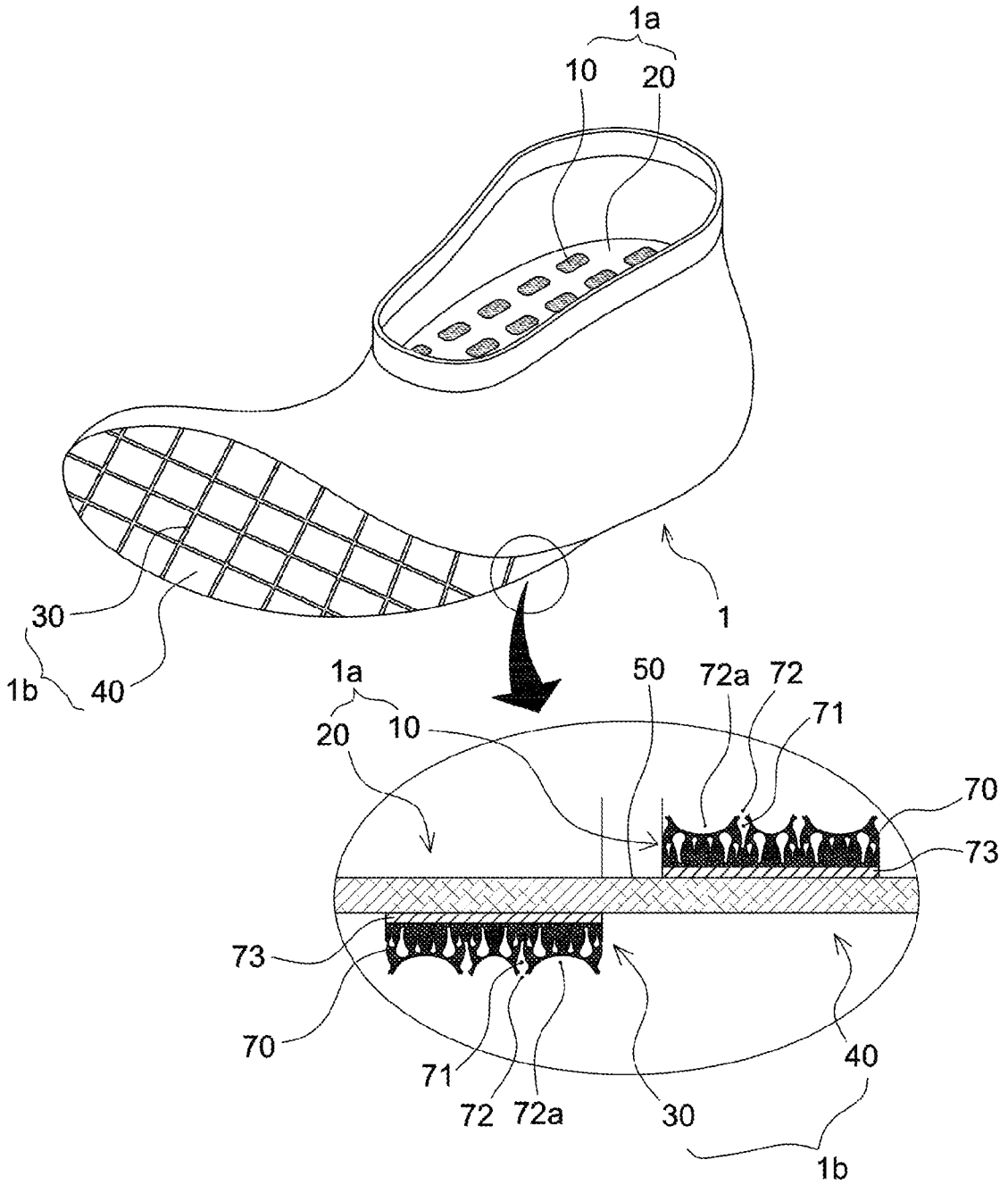
FIG. 1 is a perspective view and a sectional view of the main part of the non-slip shoe wear according to the present invention.

1: shoe wear body
1*a*: inner surface part
1*b*: outer surface part
2: foot
3: shoe
4: sweat
10: inner non-slip section
11: center bonded layer
12: outer non-bonded layer
20: inner slip sections
30: outer non-slip sections
40: outer slip sections
50: blank portions
70: wet-type polyurethane sheet

71: column cells
72: non-slip grooves
72*a*: assistant grooves
73: hot-melt bonded layer
90: upper drain space
91: lower drain space

DETAILED DESCRIPTION OF THE PREFERRED EMBODIMENT

The present invention, as shown in FIG. 1, relates to a shoe wear having an inner surface part (1*a*), which comes in contact with the foot of a wearer, on the sole of a shoe wear body (1) in which the wearer's foot is accommodated, and an outer surface part (1*b*) beneath the sole.

The shoe wear body (1) may be made of various fabrics, but in more detail, it is preferable that the shoe wear body (1) is made of a permeable fabric that can pass water between the inner surface part (1*a*) and the outer surface part (1*b*).

This can be sufficiently achieved by forming spaces between adjacent wefts and warps in the process of weaving the wefts and warps, and common socks are fabricated in this weaving method to be able to pass water.

In this shoe wear of the present invention, as described above, the inner surface part (1*a*) is composed of inner non-slip sections (10*a*) made of a material preventing a slip, and inner slip sections (20) that are sections where the inner non-slip sections (10) are not formed.

Further, the outer surface part (1*b*) is composed of outer non-slip sections (30) made of a material preventing a slip, and outer slip sections (40) that are sections where the outer non-slip sections (30) are not formed.

In FIG. 1, the inner non-slip sections (10) are formed in a substantially rectangular shape and are continuously arranged and spaced apart from each other transversely and longitudinally.

An example in the outer non-slip sections (30) are positioned between the inner non-slip sections (10) spaced apart from each other in a lattice shape is shown in FIG. 1.

However, the inner non-slip sections (10) and the outer non-slip sections (30) are not limited to the example shown in FIG. 1, and may be formed in various shapes, as shown in FIGS. 7A to 11.

As shown in the main part cross-sectional view of FIG. 1, the inner non-slip sections (10) and the outer non-slip sections (30) are alternately arranged not to vertically overlap in a side cross-section.

Referring to plan views of FIGS. 7A to 10, it can be seen that the inner non-slip sections (10) and the outer non-slip sections (30) are arranged in different spaces without overlapping each other in a plane.

Further, any materials such as silicon and rubber can be applied to the inner non-slip sections (10) and the outer non-slip sections (30) of the present invention as long as they have an anti-slip function, but it is the most preferable to use a processed wet-type polyurethane sheet.

The structure of a processed wet-type polyurethane sheet constituting the inner non-slip sections (10) and the outer non-slip sections (30) is described with reference to the main part cross-sectional view 1. A plurality of column cells (71) having a tumbler shape having the inner diameter of a distal end portion larger than the inner diameter of a close end portion from the portion fixed to the shoe wear body (1) are formed inside.

Further, non-slip grooves (72) that entirely or partially communicate with column cells (71) are formed on the surface of the distal end side from the portion fixed to the shoe wear body (1).

Further, assistant grooves (72*a*) are additionally formed on the surface of the distal end side.

A detailed method for forming this structure is described. Polyurethane is dissolved in dimethylformamide and applied to a carrier by comma coating or knife coating, and is the put and cured in a curing container filled with a mixed solution of water and dimethylformamide, and then the dimethylformamide is removed, remaining dimethylformamide is removed using hot air, and then drying is performed, thereby forming a urethane sheet. Thereafter, the carrier is removed and the surface with the carrier removes is processed such that the non-slip grooves (72) are formed.

According to this fabricating method, the tumbler-shaped column cells (71) are formed in the curing process and the non-slip grooves (72) are formed in the process of removing the carrier such as a fabric or a polyester film. In this structure, when the carrier is removed, a non-slip surface, that is, a grapping surface is formed such that sweat is absorbed well.

The non-slip grooves (72) may not be formed, depending on the material of the carrier, so the assistant grooves (72*a*) may be formed through surface processing such as polishing with sandpaper.

It is preferable to attach the non-slip material using a hot-melt adhesive in the example using a wet-type polyurethane sheet.

An example in which a hot-melt bonded layer (73) formed by applying a hot-melt adhesive is formed between the outer non-slip section (30) and the shoe wear body (1) and between the inner non-slip section (10) and the shoe wear body (1) is shown in FIGS. 1 to 6.

In general, a hot-melt adhesive is made from a substance having a complete waterproof ability or high waterproof ability such as polyethylene, polyisobutylene, polyamide, and glue.

Further, as shown in FIG. 1, the inner non-slip section (10) and the outer non-slip section (30) may be alternately arranged to form blank portions (50) such that vertically adjacent ends are spaced apart from each other in a side cross-section.

The length 'a' of the blank portions (50) can be adjusted in accordance with various factors such as the flexibility, and the intensity of upper vertical and horizontal loads of the shoe wear body (1).

If there is no blank portion (50), that is, when the inner non-slip section (10) and the outer non-slip section (30) are just alternately arranged, a phenomenon in which the inner non-slip section (10) and the outer non-slip section (30) are equally disposed at a specific vertical point due to the flexibility, etc. of the shoe wear body (1), depending on cases, may occur, and load and friction are transmitted down, as they are, at the portion, so the possibility of an injury to the skin of a user is increased.

That is, the blank portions (50) prevent the phenomenon in which the inner non-slip section (10) and the outer non-slip section (30) from being moved into a vertical straight line due to flexible movement of the member.

Figure 2:
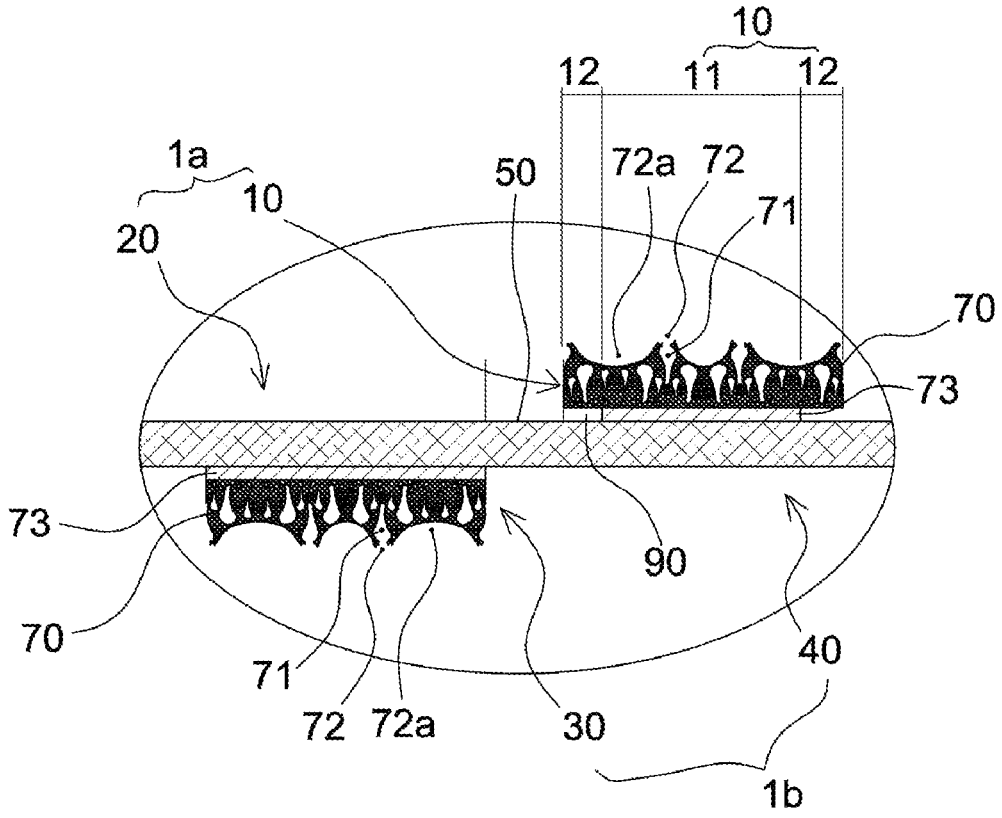
FIG. 2 is a cross-sectional view showing an example consisting of inner non-slip sections, a center bonded layer, and an outer non-bonded layer in the present invention.

Meanwhile, the hot-melt bonded layer (73), as shown in FIG. 1, has the same area as the areas of the inner non-slip section (10) and the outer non-slip section (30), but as shown FIG. 2, may be configured to have a larger area only on the inner non-slip section (10).

In detail, in FIG. 2, the end of the hot-melt bonded layer (73) is positioned inward further than the end of a wet-type polyurethane sheet (70) constituting the inner non-slip section (10). The wet-type polyurethane sheet (70) is composed of a center bonded layer (11) bonded to the hot-melt bonded layer (73) and an outer non-bonded layer (12) of which the edge is not bonded to the hot-melt bonded layer (73), thereby forming an upper drain space (90) spaced apart from the shoe wear body (1).

The size of the outer non-bonded layer (12) may be increased and decreased by various factors.

Figure 3:
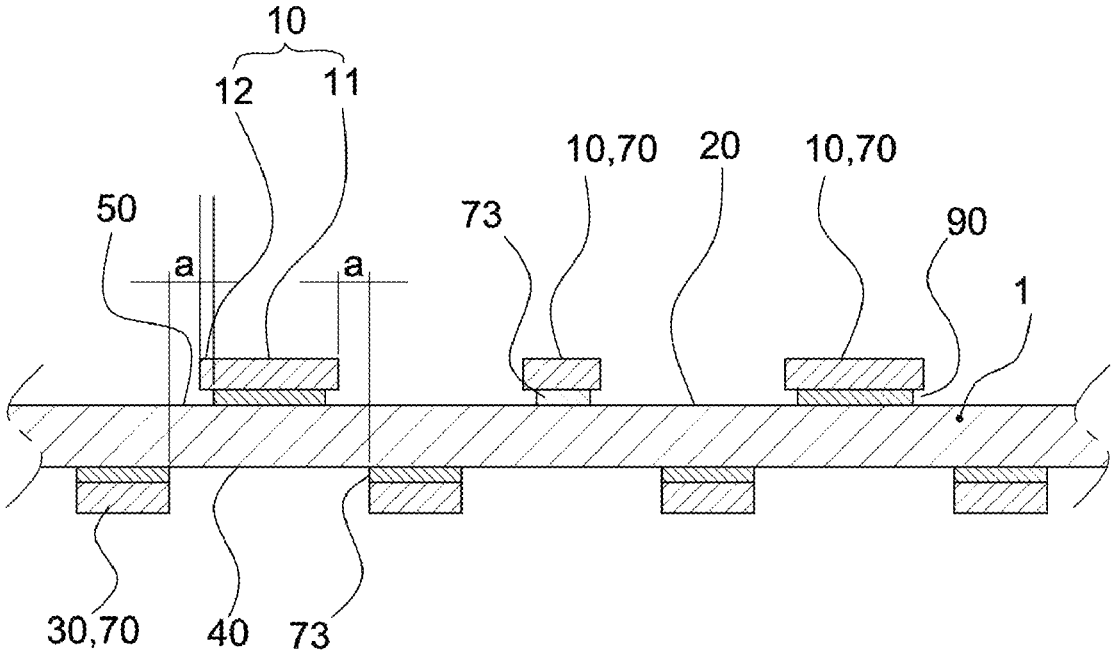
FIG. 3 is a side cross-sectional view before operation of the non-slip shoe wear according to the present invention.

This configuration is shown in FIG. 3.

Meanwhile, when the outer non-bonded layer (12) is formed, the outer non-bonded layer (12) may be formed along the entire edge of the center bonded layer (11) in a plane but may be formed only in some areas along a portion with high possibility of deformation.

Figure 7A:
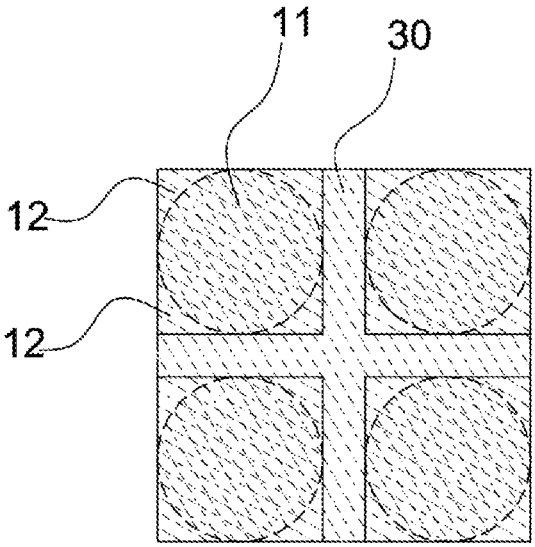
FIG. 7A to FIG. 10 are plan views showing other arrangement states of inner non-slip sections and outer non-slip sections according to the present invention.
Figure 7B:
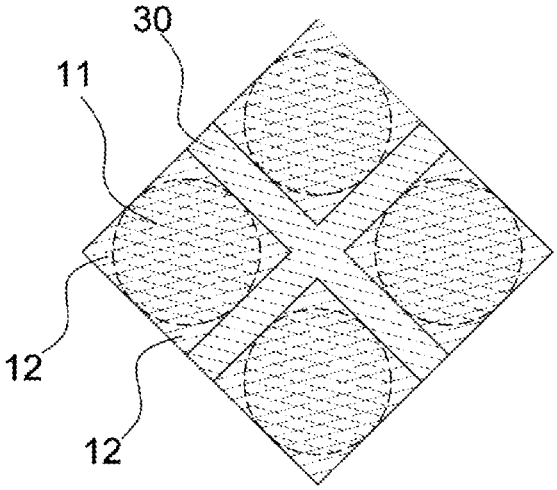
Figure 8:
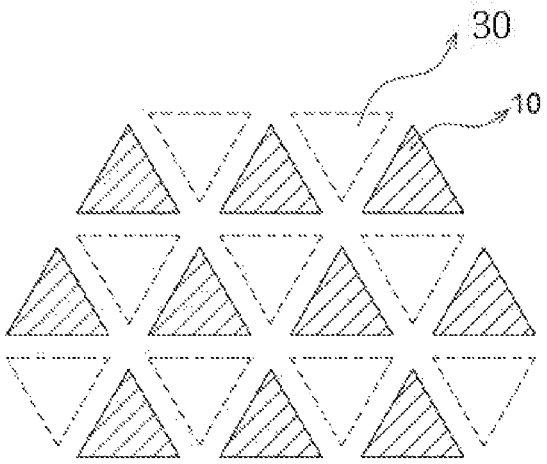
Figure 9:
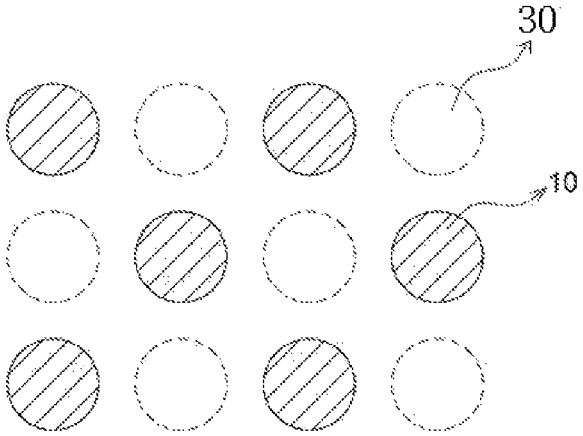
Figure 10:
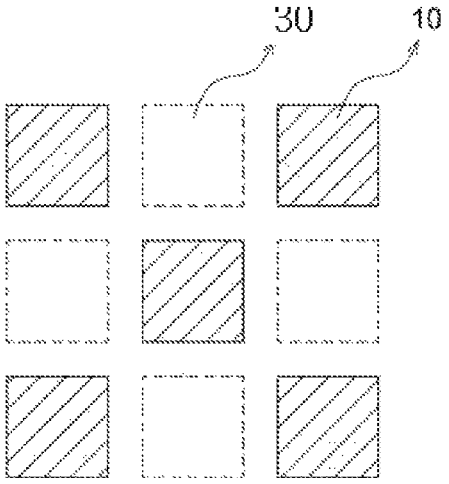

A detailed embodiment is shown in FIGS. 7A to 7B.

In the configuration of FIGS. 7A to 7B, the wet-type polyurethane sheet (70) is bonded to the shoe wear body (1) through the hot-melt bonded layer (73), the wet-type polyurethane sheets (70) constituting the inner non-slip section (10) have a square shape and are spaced apart from each other transversely and longitudinally, the hot-melt bonded layer (73) bonding the wet-type polyurethane sheets (70) constituting the inner non-slip section (10) and the shoe wear body (1) has a circular shape inscribed to the square polyurethane sheets (70), the wet-type polyurethane sheets (70) constituting the inner non-slip section (10) is composed of the center bonded layer (11) bonded to the hot-melt bonded layer (73) and the outer non-bonded layer (12) forming the upper drain space (90) spaced apart from the shoe wear body (1) without the bottom bonded to the hot-melt bonded layer (73), and the outer non-slip section (30) is disposed between adjacent inner non-slip sections (10) in a plane.

FIG. 7A is an example, in which the outer non-slip sections (30) make a lattice shape in parallel with perpendicularly to the longitudinal direction a shock, and FIG. 7B is an example, in which it is twisted at 45 degrees from the longitudinal direction of the shock to make a shape deformed at 45 degrees in the arrangement of FIG. 7A.

That is, the outer non-bonded layer (12) has a shape positioned at the end of a +-shape from the center in FIG. 7A and has a shape positioned at the end of an X-shape from the center in FIG. 7B.

That is, in the entire configuration, the ends of the outer non-slip section (30) and the inner non-slip section (10) make vertically a straight line, the hot-melt bonded layers (73) are disposed to make vertically a straight line in a cross-section in areas where they do not easily overlap each other, and the outer non-bonded layer (12) is formed in areas with high possibility of overlap, whereby it is possible to maximize motion ability by suppressing possibility of an injury to a skin and maximizing the non-slip function.

In particular, in the figures, the outer non-bonded layer (12) has a shape in which the length of the portion being in contact with the circular bonded layer (11) is large and the end is sharp, so the contact area decreases toward the end, whereby it is possible to further minimize deterioration of the non-slip function.

The main operation of the present invention according to this configuration is described hereafter.

In FIG. 3, the shoe wear body (1) has a flat shape without an external load.

Figure 4:
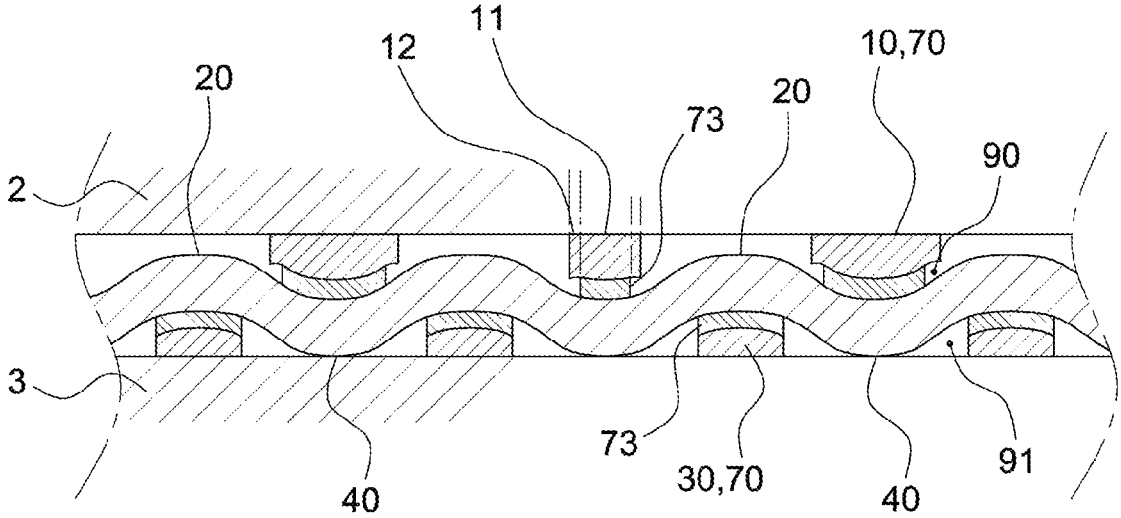
FIG. 4 is a side cross-sectional view showing a state after wearing in FIG. 3.

In this state, the sole of a user's foot presses the shoe wear body (1), and when friction due to a motion is applied in this state, the state shown in FIG. 4 is made.

In this state, the outer slip section (40) that is the surface of the sole of the shoe wear body (1) is positioned right under each of the inner non-slip sections (10) without the outer non-slip section (30).

Accordingly, the inner non-slip sections (10) to which compressive load and friction force are applied have the bottom not made of the same material and are simply fiber tissues of the shoe wear body (1), so function as a slip with a relatively less slip function, thereby reducing friction force.

This is not a type intensively reducing friction force at one point, but primarily reduces friction at the inner non-slip sections (10) and secondarily reduces friction at the outer non-slip sections (30) not in right-under areas but in surrounding areas, whereby it is possible to prevent an injury to the skin by giving an intensive non-slip function to the foot (2) of the wearer and it is also possible to increase the motion ability.

In this configuration, when the blank portions (50) are formed, as described above, the phenomenon in which the inner non-slip sections (10) and the outer non-slip sections (30) overlap each other in specific areas due to various factors such as the member characteristics, the motion direction, and the force, thereby being able to further prevent an injury to the skin.

However, when the blank portions (50) are entirely formed, the inner non-slip sections (10) and the outer non-slip sections (30) fundamentally do not overlap at the portions where the blank portions (50) are formed, so a slip necessarily occurs.

When the inner non-slip section (10) is composed of the center bonded layer (11) and the outer non-bonded layer (12), as shown in FIG. 3, this phenomenon can be minimized.

When the inner non-slip section (10) is composed of the center bonded layer (11) and the outer non-bonded layer (12), the hot-melt bonded layers (73) is not attached to the bottom of the outer non-bonded layer (12), so the outer non-bonded layer (12) is spaced apart from the shoe wear body (1) too.

Accordingly, when the load of a user is applied to both of center bonded layer (11) and the outer non-bonded layer (12), friction force is much large at the center bonded layer (11) and is relatively small at the outer non-bonded layer (12).

Figure 6:
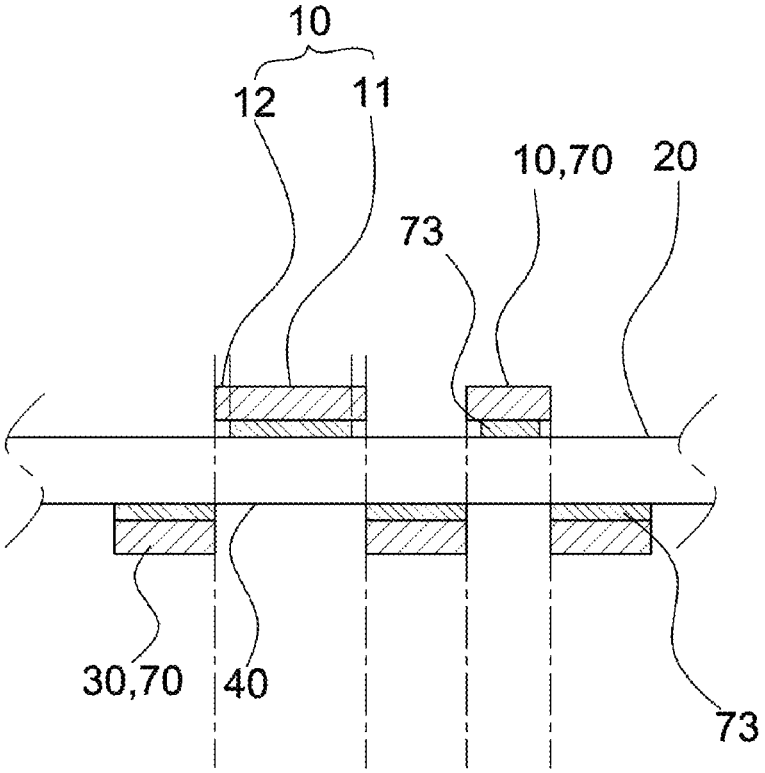
FIG. 6 is a cross-sectional view showing another arrangement state of inner non-slip sections and outer non-slip sections according to the present invention.

In FIG. 6, the boundaries of the inner non-slip section (10) and the outer non-slip section (30) make a vertical straight line. If the area of the hot-melt bonded layers (73) is the same as the areas of the inner non-slip section (10) and the outer non-slip section (30), the phenomenon in which the inner non-slip section (10) and the outer non-slip section (30) overlap each other, as described above, may occur.

However, as can be seen from the figure, since the inner non-slip section (10) is composed of the center bonded layer (11) and the outer non-bonded layer (12), the bottom of the outer non-bonded layer (12) is not fixed to the shoe wear body (1) even though the phenomenon in which the ends of the inner non-slip section (10) and the outer non-slip section (30) slightly overlap occurs, so the non-slip function is not maximized in this area.

That is, the top surface of the outer non-bonded layer (12) shows the non-slip function by making friction with a user's foot, but the bottom of the outer non-bonded layer (12) can slip within a predetermined limit on the shoe wear body (1), thereby being able to suppress an injury to a skin.

Further, the outer non-bonded layer (12) activates absorption and discharge of water.

Figure 5:
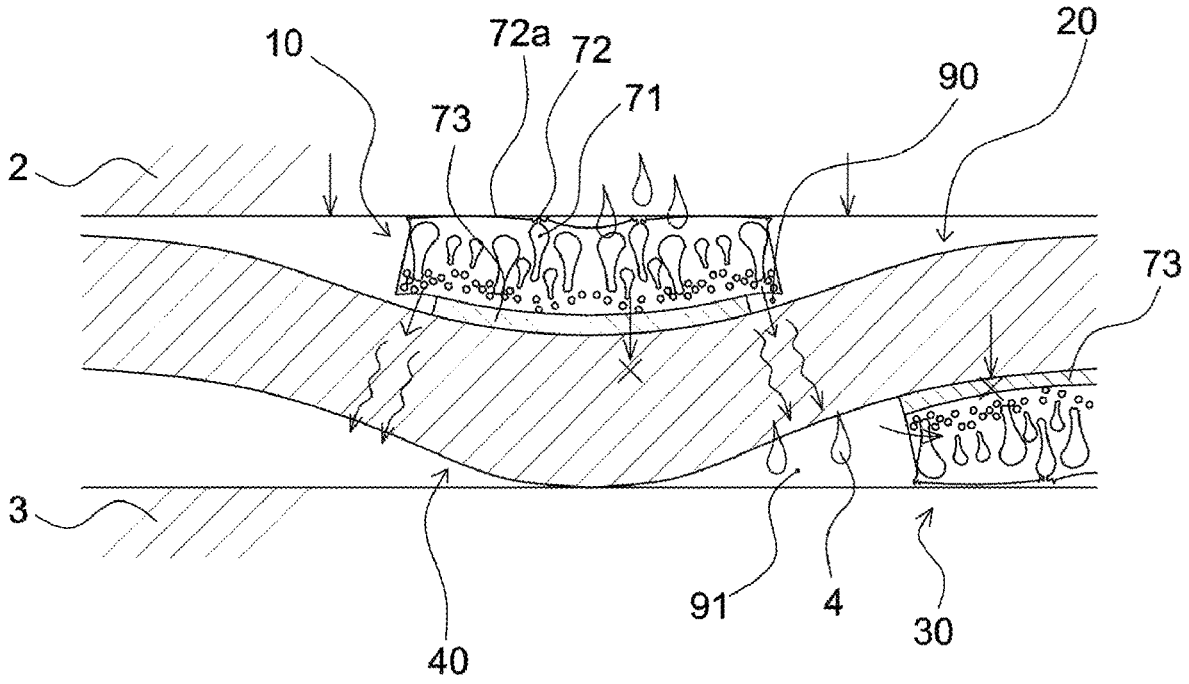
FIG. 5 is a schematic diagram showing the flow of sweat according to the present invention.

FIG. 5 shows the state when sweat (4) is absorbed and discharged.

First, the since the column cells (71) and the non-slip grooves (72) are formed on the inner non-slip section (10), sweat coming out of the foot (2) of the wearer is absorbed.

In this case, since the hot-melt bonded layers (73) is generally made of a substantially waterproof material, absorption of sweat is delayed in the hot-melt bonded layers (73), and when sweat keeps being produced, the sweat moves through the bottom and the sides of the outer non-bonded layer (12).

However, the upper drain space (90) that is an empty space between the user's foot (2) and the shoe wear body (1) is formed due to wave-shaped cross-sectional deformation of the shoe wear body (1) at this portion, as shown in the figure, so a small amount of sweat temporarily stays.

Further, as described above, when the shoe wear body (1) is made of a permeable material having a sweat absorption/discharge function like common sports socks, sweat is absorbed into the shoe wear body (1).

In this state, when sweat keeps being produced, the sweat flows to the sole of a shoe (3), and in this case, absorption of sweat is suppressed by the hot-melt bonded layers (73) and the sweat temporarily collects in a lower drain space (91), in the area where the outer non-slip section (30) of the outer surface part (1*b*) of the shoe wear body (1).

That is, this is because the bottom of the shoe wear body (1) is supported by the shoe (3) or the surface of an insole, and the inner non-slip sections (10) and the outer non-slip section (30) are alternatively arranged, so the lower stay space (91) that is an empty space is formed at sides of the sides of the outer non-slip sections (30) due to wave-shaped deformation of the shoe wear body (1), as shown in the figure.

In this state, the water collects in the lower stay space (91) is absorbed into the column cells (21) of the outer non-slip section (30) through the sides of the outer non-slip section (30) or the gap between the shoe (3) and the end of the outer non-slip section (30).

According to the present invention as described above, the non-slip shoe wear of the present invention has been designed to prevent an injury to the skin by preventing an excessive non-slip function over an appropriate non-slip function because a material preventing a slip is alternately disposed on the inner surface and the outer surface of a shoe wear body.

In more detail, an anti-slip substance is configured as a wet-type polyurethane sheet having a tumbler-shaped column cells and non-slip grooves to improve a non-slip function. Further, the anti-slip substances are alternately arranged on the inner and outer surfaces of the shoe wear body to be able to an excessive non-slip function.

In particular, the wet-type polyurethane sheet is bonded and fixed to the shoe wear body in a hot-melt type and the inner side that comes in direct contact with a foot of a user is formed such that the hot-melt bonded layer is smaller in size than the wet-type polyurethane sheet, so the gap between the inner non-slip section and the outer non-slip section is minimized, thereby preventing deterioration of a non-slip function due to alternate arrangement. Further, the inner non-slip section has an outer non-bonded layer not bonded by the hot-melt bonded layer to minimize an injury to the wearer's body even if the inner non-slip section and the outer non-slip section overlap due to flexible deformation of the shoe wear body.

Further, an upper drain space spaced apart from the shoe wear body is naturally formed under the outer non-bonded layer, so a space in which remaining sweat not absorbed into the shoe wear body is discharged and stays is formed by the upper drain space to prevent deterioration of the non-slip function due to a large amount of sweat and provide pleasant fit.

While the present invention has been described with respect to the specific embodiments, it will be apparent to those skilled in the art that various changes and modifications may be made without departing from the spirit and scope of the invention as defined in the following claims.

INDUSTRIAL APPLICABILITY

The non-slip shoe wear of the present invention can be applied to a variety of clothing such as sports socks, mountaineering socks, tights, over socks, life socks etc. that directly wraps and protects the wearer's feet.

What is claimed is:

1. A non-slip shoe wear having an inner surface part (1*a*), which is configured to, when in use, come in contact with a foot of a wearer, on a sole of a shoe wear body (1) in which the wearer's foot is accommodated, and an outer surface part (1*b*) beneath the sole, wherein the inner surface part (1*a*) is composed of inner non-slip sections (10) made of a material for preventing a slip, and inner slip sections (20) that are sections where the inner non-slip sections (10) are not formed; the outer surface part (1*b*) is composed of outer non-slip sections (30) made of a material preventing a slip, and outer slip sections (40) that are sections where the outer non-slip sections (30) are not formed; and the inner non-slip sections (10) and the outer non-slip sections (30) are alternately arranged not to vertically overlap in a side cross-section;

wherein a plurality of column cells (71) having a tumbler shape having an inner diameter of a distal end larger than an inner diameter of a close end portion from a portion fixed to the shoe wear body (1) are formed on each of the outer non-slip sections (30) and the inner non-slip sections (10), and the outer non-slip sections (30) and the inner non-slip sections (10) are each made of a wet-type polyurethane sheet (70) having non-slip grooves (72) that entirely or partially communicate with column cells (71) are formed on a surface of a distal end side from the portion fixed to the shoe wear body (1); and wherein the wet-type polyurethane sheet (70) is bonded to the shoe wear body (1) through a hot-melt bonded layer (73); an end of the hot-melt bonded layer (73) is positioned inward further than an end of a wet type polyurethane sheet (70) constitution the inner non-slip sections (10); and the wet-type polyurethane sheet (70) is composed of a center bonded layer (11) bonded to the hot-melt bonded layer (73) and an outer non-bonded layer (12) of which an edge is not bonded to the hot-melt bonded layer (73), thereby forming an upper drain space (90) spaced apart from the shoe wear body (1).

2. The non-slip shoe wear of claim 1, wherein the inner non-slip section (10) and the outer non-slip sections (30) are alternately arranged to form blank portions (50) such that vertically adjacent ends are spaced apart from each other in a side cross-section.

3. A non-slip shoe wear having an inner surface part (1*a*), which is configured to, when in use, come in contact with a foot of a wearer, on a sole of a shoe wear body (1) in which the wearer's foot is accommodated, and an outer surface part (1*b*) beneath the sole, wherein the inner surface part (1*a*) is composed of inner non-slip sections (10) made of a material for preventing a slip, and inner slip sections (20) that are sections where the inner non-slip sections (10) are not formed; the outer surface part (1*b*) is composed of outer non-slip sections (30) made of a material preventing a slip, and outer slip sections (40) that are sections where the outer non-slip sections (30) are not formed; and the inner non-slip sections (10) and the outer non-slip sections (30) are alternately arranged not to vertically overlap in a side cross-section;

wherein a plurality of column cells (71) having a tumbler shape having an inner diameter of a distal end larger than an inner diameter of a close end portion from a portion fixed to the shoe wear body (1) are formed on each of the outer non-slip sections (30) and the inner non-slip sections (10), and the outer non-slip sections (30) and the inner non-slip sections (10) are each made of a wet-type polyurethane sheet (70) having non-slip grooves (72) that entirely or partially communicate with column cells (71) are formed on a surface of a distal end side from the portion fixed to the shoe wear body (1); and wherein the wet-type polyurethane sheet (70) is bonded to the shoe wear body (1) through the hot-melt bonded layer (73); the wet-type polyurethane sheets (70) constituting the inner non-slip sections (10) have a square shape and are spaced apart from each other transversely and longitudinally in the shoe wear body (1); the hot-melt bonded layer (73) bonding the wet-type polyurethane sheets (70) constituting the inner non-slip sections (10) and the shoe wear body (1) has a circular shape is inscribed to the square polyurethane sheets (70); the wet-type polyurethane sheets (70) constituting the inner non-slip sections (10) are composed of the center bonded layer (11) bonded to the hot-melt bonded layer (73) and the outer non-bonded layer (12) forming the upper drain space (90) spaced apart from the shoe wear body (1) without a bottom bonded to the hot-melt bonded layer (73); and the outer non-slip sections (30) are disposed between adjacent inner non-slip sections (10) in a plane.

* * * * *